US008561680B2

(12) United States Patent
Jiang et al.

(10) Patent No.: US 8,561,680 B2
(45) Date of Patent: Oct. 22, 2013

(54) HEAT EXCHANGER

(75) Inventors: Jianlong Jiang, Hangzhou (CN); Feng Wang, Hangzhou (CN); Linjie Huang, East Amherst, NY (US)

(73) Assignee: Sanhua Holding Group Co., Ltd., Shaoxing, Zhejiang Province (CN)

( * ) Notice: Subject to any disclaimer, the term of this patent is extended or adjusted under 35 U.S.C. 154(b) by 664 days.

(21) Appl. No.: 12/806,620

(22) Filed: Aug. 17, 2010

(65) Prior Publication Data

US 2011/0203780 A1 Aug. 25, 2011

(30) Foreign Application Priority Data

Feb. 22, 2010 (CN) ..... 2010 1 0113150

(51) Int. Cl.
*F28F 9/22* (2006.01)
*F28F 9/04* (2006.01)

(52) U.S. Cl.
USPC ..... 165/174; 65/178

(58) Field of Classification Search
CPC ..... F28F 9/027; F28F 9/0273; F28F 9/0246; F28F 9/12
USPC ..... 165/173, 174, 175, 176, 153, 178; 62/525
See application file for complete search history.

(56) References Cited

U.S. PATENT DOCUMENTS 2,097,602 A * 11/1937 Rohlin ..... 237/74
3,209,820 A * 10/1965 Lauterbach ..... 165/174
5,526,876 A * 6/1996 Karube ..... 165/176
6,199,401 B1 * 3/2001 Haussmann ..... 62/525
6,729,386 B1 * 5/2004 Sather ..... 165/110
2002/0174978 A1 * 11/2002 Beddome et al. ..... 165/174
2007/0039724 A1 * 2/2007 Trumbower et al. ..... 165/174
2008/0093051 A1 * 4/2008 Rios et al. ..... 165/61
2009/0173482 A1 7/2009 Beamer et al.
2010/0116474 A1 5/2010 Kerler et al.

FOREIGN PATENT DOCUMENTS

CN 1523317 A 1/2004
CN 101111730 A 12/2005
CN 101482346 A 7/2009
CN 101680689 A 3/2010
JP 200555013 A 3/2005
WO 2006083426 A1 8/2006

* cited by examiner

*Primary Examiner* — Tho V Duong
(74) *Attorney, Agent, or Firm* — Howard & Howard Attorneys PLLC

(57) ABSTRACT

A heat exchanger includes headers and tubes two ends of each of which are connected with and communicate the headers. Each of fins is disposed between adjacent tubes. An end cover is formed with a center hole and fixed to a proximal end of one of the headers. A distal end of a sleeve passes through the center hole to extend into the header, and a proximal end of the sleeve is held by a proximal end surface of the end cover. A first distribution-collection tube is fixed to the sleeve and defines an open proximal end and a closed distal end passing through the sleeve to extend into the header in which openings are formed along a longitudinal direction of the distribution-collection tube in a portion thereof extended into the header. A fixing nut is screwed onto the end cover to press the proximal end of the sleeve against the proximal end surface of the end cover.

14 Claims, 6 Drawing Sheets

HEAT EXCHANGER

BACKGROUND OF INVENTION

1. Field of Invention

The invention relates, generally, to a heat exchanger and, more particularly, to a heat exchanger used as an evaporator and a condenser.

2. Description of Related Art

FIG. 4 shows a conventional heat exchanger of "parallel flow" type, which comprises a first header 1', a second header 2', a plurality of tubes 3', a plurality of fins 4', a first connection pipe 5', and a second connection pipe 6'. The first connection pipe 5' is welded to the proximal end of the first header 1', and the second connection pipe 6' is welded to the proximal end of the second header 2'. A plurality of tubes 3' are connected between the first and second headers 1', 2', and, as shown in FIG. 5, two ends of each tube 3' are partially extended into the first and second headers 1' and 2', respectively.

When the heat exchanger is used as an evaporator, the first header 1' is used as an inlet header and the second header 2' is used as an outlet header. A mixture of liquid and vapor refrigerant enters the first header 1' from the first connection pipe 5' along solid-line arrow "A'," then becomes vapor refrigerant after exchanging heat with the external environment during passage through the plurality of tubes 3', and is finally discharged out of the heat exchanger via the second connection pipe 6'.

When the heat exchanger is used as a condenser, the second header 2' is used as an inlet header, and the first header 1' is used as an outlet header. Vapor refrigerant enters into the second header 2' from the second connection pipe 6' along dashed-line arrow "B'," then becomes liquid refrigerant after exchanging heat with the external environment during passage through the plurality of tubes 3', and is finally discharged out of the heat exchanger via the first connection pipe 5'.

Since two ends of each tube 3' are partially extended into the first and second headers 1' and 2', respectively, the refrigerant in the first header 1' or second header 2', which is used as an inlet header, may be disturbed or influenced disadvantageously by the portions of the plurality of tubes 3' extended into the inlet header, and separation of vapor refrigerant and liquid refrigerant in the two-phase flow may occur. In addition, the distribution of the refrigerant in the first header 1' or second header 2' is not uniform so that the amount of the refrigerant distributed in each of the plurality of tubes 3' is not uniform, which may result in inefficient heat transfer.

Further, as shown in FIG. 5, since two ends of each tube 3' are partially extended into the first and second headers 1' and 2', respectively, when the first header 1' or second header 2' is used as an outlet header, the flow of the refrigerant in the outlet header may be disturbed disadvantageously by the portions of the plurality of tubes 3' extended into the outlet header, thus causing spiral vortexes. And, the flow resistance is large especially in the outlet header used as the evaporator. In addition, the vapor refrigerant is especially affected disadvantageously by the portions of the plurality of tubes 3' extended into the outlet header, and more spiral vortexes will be generated. In order to balance the flow resistance, the flow rate in the plurality of tubes 3' at the distal end of the header is much smaller than that in the plurality of tubes 3' at the proximal end of the header, thus causing the refrigerant distribution in the plurality of tubes 3' to be non-uniform, which can result in inefficient heat transfer. At the same time, the large flow resistance in the heat exchanger will result in inefficient heat transfer of the refrigeration system employing the heat exchanger.

In addition, the first and second connection pipes 5', 6' are welded directly to the proximal ends of the first and second headers 1', 2', respectively, so that the replacement and maintenance are not convenient, thus disadvantageously affecting the convenience of use.

Thus, there is a need in the related art for improvement of heat-transfer performance of a heat exchanger. More specifically, there is a need in the related art for improvement of uniform distribution of the refrigerant. Also, there is a need in the related art for non-disturbance of flow of the refrigerant. And, there is a need in the related art for improvement of heat-transfer efficiency. Furthermore, there is a need in the related art for facilitation of replacement and maintenance. In addition, there is a need in the related art for satisfaction of requirements of different types of heat exchangers used in different applications. Moreover, there is a need in the related art for effective removal regularly. Plus, there is a need in the related art for extension of service life of the heat exchanger. There is a need in the related art for effective adjustment of distribution of the refrigerant as well.

SUMMARY OF INVENTION

The invention overcomes the disadvantages in the related art in a heat exchanger including a first header, a second header spaced apart from the first header by a predetermined distance, and a plurality of tubes two ends of each of which are connected with the first and second headers so as to communicate the first and second headers, respectively. Each of a plurality of fins is disposed between adjacent ones of the tubes. A first end cover is formed with a first center hole and fixed to a proximal end of the first header. A distal end of a first sleeve passes through the first center hole so as to extend into the first header, and a proximal end of the first sleeve is held by a proximal end surface of the first end cover. A first distribution-collection tube is fixed to the first sleeve and defines an open proximal end and a closed distal end passing through the first sleeve to extend into the first header in which a plurality of first openings are formed along a longitudinal direction of the first distribution-collection tube in a portion of the first distribution-collection tube extended into the first header. A first fixing nut is screwed onto the first end cover so as to press the proximal end of the first sleeve against the proximal end surface of the first end cover.

One advantage of the heat exchanger of the invention is that heat-transfer performance of a heat exchanger is improved.

Another advantage of the heat exchanger of the invention is that uniform distribution of the refrigerant is improved.

Another advantage of the heat exchanger of the invention is that flow of the refrigerant is not disturbed.

Another advantage of the heat exchanger of the invention is that heat-transfer efficiency is improved.

Another advantage of the heat exchanger of the invention is that replacement and maintenance are facilitated.

Another advantage of the heat exchanger of the invention is that requirements of different types of heat exchangers used in different applications are satisfied.

Another advantage of the heat exchanger of the invention is that effective removal is regular.

Another advantage of the heat exchanger of the invention is that service life of a heat exchanger is extended.

Another advantage of the heat exchanger of the invention is that distribution of the refrigerant is effectively adjusted.

Other objects, features, and advantages of the heat exchanger of the invention will be readily appreciated as the same becomes better understood while reading the subsequent description taken in conjunction with the accompanying drawings.

BRIEF DESCRIPTION OF EACH FIGURE OF DRAWING

FIG. 1*a* is a schematic view of the heat exchanger according to an embodiment of the invention.

FIG. 1*b* is a partial cross-sectional view of the heat exchanger shown FIG. 1*a*.

FIGS. 2*a*-2*e* show different forms of the first and second distribution-collection tubes of the heat exchanger according to embodiments of the invention.

FIG. 3*a* is a plan view of the first distribution-collection tube of the heat exchanger used as an evaporator according to an embodiment of the invention.

FIG. 3*b* is a cross-sectional view of the first distribution-collection tube of the heat exchanger used as an evaporator according to an embodiment of the invention.

FIG. 3*c* is a plan view of the second distribution-collection tube of the heat exchanger used as an evaporator according to an embodiment of the invention.

FIG. 3*d* is a cross-sectional view of the second distribution-collection tube of the heat exchanger used as an evaporator according to an embodiment of the invention.

FIG. 3*e* is a plan view of the first distribution-collection tube of the heat exchanger used as a condenser according to an embodiment of the invention.

FIG. 3*f* is a cross-sectional view of the first distribution-collection tube of the heat exchanger used as a condenser according to an embodiment of the invention.

FIG. 3*g* is a plan view of the second distribution-collection tube of the heat exchanger used as a condenser according to an embodiment of the invention.

FIG. 3*h* is a cross-sectional view of the second distribution-collection tube of the heat exchanger used as a condenser according to an embodiment of the invention.

FIG. 3*i* shows an embodiment of the first or second distribution-collection tube that is used as outlet header of the heat exchanger according to an embodiment of the invention.

FIG. 3*j* shows another embodiment of the first or second distribution-collection tube that is used as outlet header of the heat exchanger according to another embodiment of the invention.

DETAILED DESCRIPTION OF EMBODIMENTS OF INVENTION

Figure 1A:
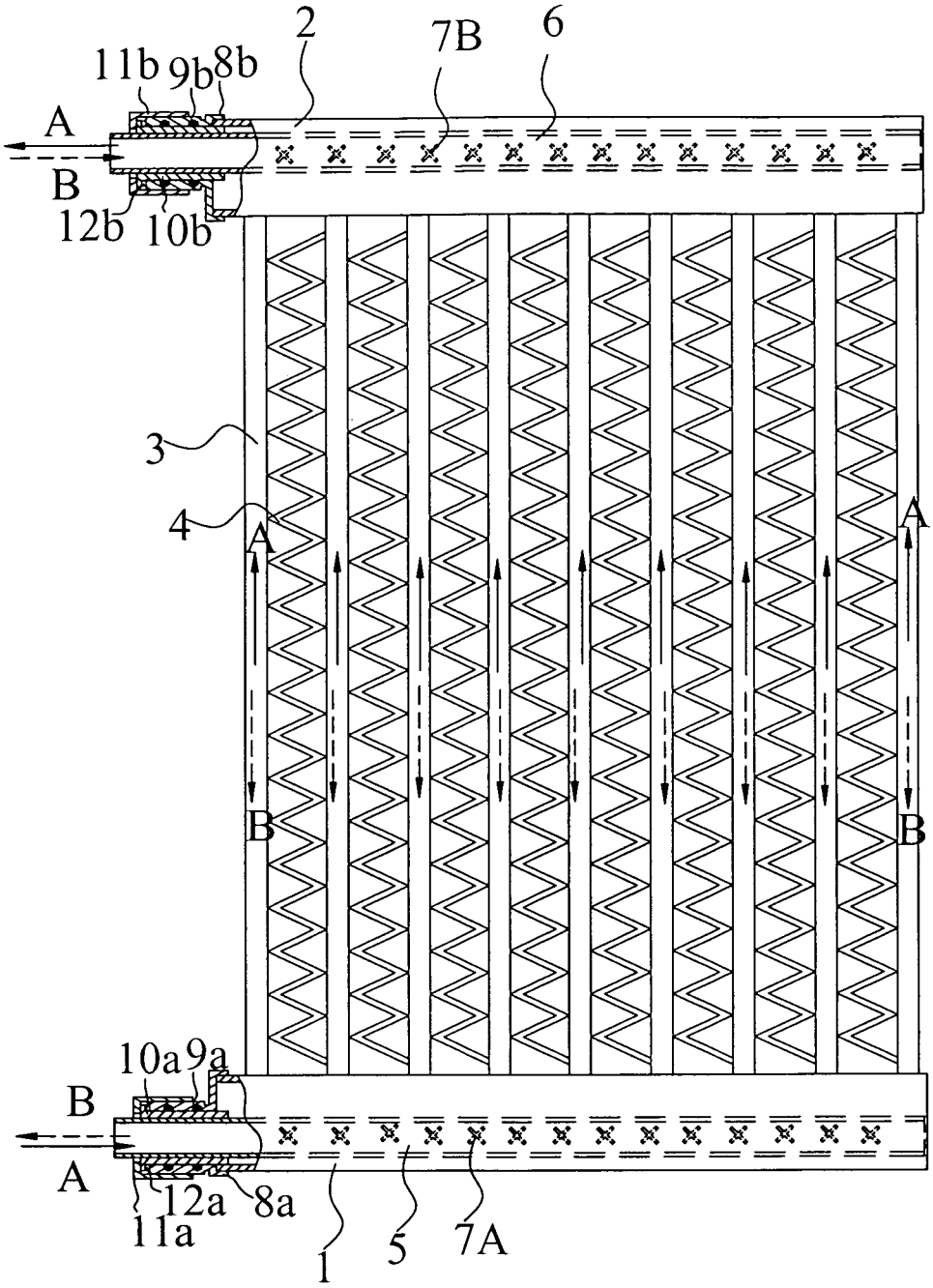

As shown in FIG. 1*a*, the heat exchanger according to an embodiment of the invention includes a first header 1, a second header 2, a first end cover 8*a*, a first sleeve 10*a*, a first fixing nut 11*a*, a first distribution-collection tube 5, a plurality of tubes 3, and a plurality of fins 4. The tube 3 may be a flat tube. In a further embodiment of the invention, the heat exchanger further includes a second end cover 8*b*, a second sleeve 10*b*, a second fixing nut 11*b*, and a second distribution-collection tube 6.

The second header 2 is spaced apart from the first header 1 by a predetermined distance, and the first and second headers 1, 2 are substantially parallel to each other. Two ends of each tube 3 are connected with the first and second headers 1, 2, respectively, so as to communicate the first and second headers 1, 2. As shown in FIG. 1*a*, a portion of each end of each tube 3 is extended into the first and second headers 1, 2, respectively. Each fin 4 is disposed between adjacent tubes 3.

The first end cover 8*a* is formed with a first center hole and fixed—for example, welded—to a proximal end (i.e., the left end in FIGS. 1*a* and 1*b*) of the first header 1. The second end cover 8*b* is formed with a second center hole and fixed—for example, welded—to a proximal end of the second header 2.

A distal end of the first sleeve 10*a* passes through the first center hole to extend into the first header 1, and a proximal end of the first sleeve 10*a* is held by a proximal end surface of the first end cover 8*a*. Similarly, a distal end of the second sleeve 10*b* passes through the first center hole to extend into the first header 2, and a proximal end of the second sleeve 10*b* is held by a proximal end surface of the first end cover 8*b*.

Figure 1B:
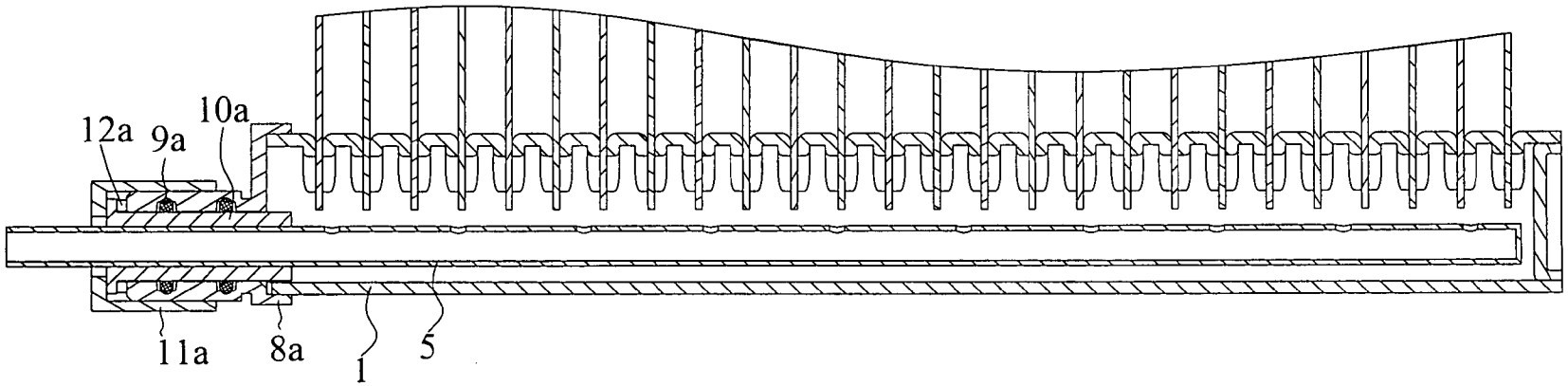

In some embodiments of the invention, as shown in FIGS. 1*a* and 1*b*, the proximal end of the first sleeve 10*a* is formed with a first flange having an outer diameter larger than a diameter of the first center hole. In this way, the proximal end of the first sleeve 10*a* may be held by the proximal end surface of the first end cover 8*a* via the first flange, thus avoiding movement toward the distal side (i.e., the right side in FIGS. 1*a* and 1*b*) of the first sleeve 10*a*. Similarly, the proximal end of the second sleeve 10*b* is formed with a second flange having an outer diameter larger than a diameter of the second center hole.

In some embodiments of the invention, a first adjustment washer 12*a* is disposed between the first flange and the proximal end surface of the end cover 8*a*, and a second adjustment washer 12*b* is disposed between the second flange and the proximal end surface of the second end cover 8*b*. Therefore, the distance between the proximal end of the first sleeve 10*a* and the proximal end of the first end cover 8*a* as well as the distance between the proximal end of the second sleeve 10*b* and the proximal end of the second end cover 8*b* is adjustable. Thus, lengths of the first and second distribution-collection tubes 5, 6 extended into the first and second headers 1, 2, respectively, are adjustable. In this way, the distribution of the refrigerant in the first and second headers 1, 2 can be effectively adjusted according to different types of heat exchangers used in different applications, thus further improving the heat-transfer performance of the heat exchanger.

As shown in FIGS. 1*a* and 1*b*, in an embodiment of the invention, first seal rings 9*a* are disposed between the first sleeve 10*a* and first end cover 8*a*, and second seal rings 9*b* are disposed between the second sleeve 10*b* and second end cover 8*b*. Therefore, the leakage of the refrigerant occurring between the first sleeve 10*a* and first end cover 8*a* as well as between the second sleeve 10*b* and second end cover 8*b* may be avoided more reliably.

The first distribution-collection tube 5 defines an open proximal end (i.e., the left end in FIG. 1*a*) and a closed distal end (i.e., the right end in FIG. 1*a*) passing through the first sleeve 10*a* so as to extend into the first header 1. That is, a portion of the first distribution-collection tube 5 is extended into the first header 1, and the first distribution-collection tube 5 is welded to the first sleeve 10*a*. A plurality of first openings 7A are formed along a longitudinal direction (i.e., the left and right direction in FIGS. 1*a* and 1*b*) of the first distribution-collection tube 5 in the portion of the first distribution-collection tube 5 extended into the first header 1. The length of the first distribution-collection tube 5 extended into the first header 1 may be equal to that of a portion of the first header 1. Advantageously, the length of the first distribution-collection tube 5 extended into the first header 1 may be substantially equal to the whole length of the first header 1. That is, the proximal end of the first distribution-collection tube 5 is extended inside the first header 1 to be adjacent to the proximal end of the first header 1. A first fixing nut 11*a* is screwed onto the first end cover 8*a* so as to press the proximal end of the first sleeve 10*a* against the proximal end surface of the first end cover 8*a*.

Similarly, the second distribution-collection tube 6 defines an open proximal end (i.e., the left end in FIG. 1*a*) and a closed distal end (i.e., the right end in FIG. 1*b*) passing through the second sleeve 10*b* so as to extend into the second header 2. That is, a portion of the second distribution-collection tube 6 is extended into the second header 2, and the second distribution-collection tube 6 is welded to the second sleeve 10*b*. A plurality of second openings 7B are formed along a longitudinal direction (i.e., the left and right direction in FIGS. 1*a* and 1*b*) of the second distribution-collection tube 6 in the portion of the second distribution-collection tube 6 extended into the second header 2. The length of the second distribution-collection tube 6 extended into the second header 2 may be equal to that of a portion of the second header 2. Advantageously, the length of the second distribution-collection tube 6 extended into the second header 2 may be substantially equal to the whole length of the second header 2. That is, the proximal end of the second distribution-collection tube 6 is extended inside the second header 2 to be adjacent to the proximal end of the second header 2. A second fixing nut 11*b* is screwed onto the second end cover 8*b* so as to press the proximal end of the second sleeve 10*b* against the proximal end surface of the second end cover 8*b*.

According to embodiments of the invention, because the first and second distribution-collection tubes 5, 6 are extended into the first and second headers, respectively, as shown in FIG. 1*a*, when the heat exchanger is used as an evaporator, the liquid refrigerant (which may contain a part of vapor refrigerant) flows within the heat exchanger along solid-line arrow "A." Particularly, the liquid refrigerant is entered into the first distribution-collection tube 5 and then distributed into the first header 1 via the first openings 7A. In this way, the flow of the refrigerants may not be affected and distributed by the portions of the plurality of tubes 3 extended into the first header 1, thus reducing the separation of vapor refrigerant and liquid refrigerant in the two-phase flow, improving the distribution uniformity of the refrigerant in the plurality of tubes 3, and thereby improving the heat-transfer performance and efficiency.

The refrigerant becomes vapor refrigerant after exchanging heat and is entered into the second header 2. Because the second distribution-collection tube 6 is disposed within the second header 2, the vapor refrigerant passes through the second openings 7B to enter into the second distribution-collection tube 6 and is finally discharged out of the second header 2 via the second distribution-collection tube 6. Therefore, the flow of the vapor refrigerant may not be affected and disturbed by the portions of the plurality of tubes 3 extended into the second header 2, thus avoiding generating vortexes, reducing the flow resistance of the refrigerant, balancing the flow resistance of the refrigerant in the plurality of tubes 3 at the distal and proximal ends of the outlet header, improving the distribution uniformity of the refrigerant in the plurality of tubes 3, and thereby improving the heat-transfer performance and efficiency.

When the heat exchanger is used as a condenser, as shown in FIG. 1*a*, the refrigerant flows in the heat exchanger along dashed-line arrow "B." Particularly, the vapor refrigerant (which may also contain a part of liquid refrigerant) is entered into the second distribution-collection tube 6 and then distributed into the second header 2 so that the distribution of the refrigerant in the plurality of tubes 3 may be more uniform. And, the flow of the refrigerant may not be affected and disturbed by the portion of each tube 3 extended into the second header 2, thereby improving the heat-transfer efficiency. The vapor refrigerant becomes the liquid refrigerant (which may also contain a part of vapor refrigerant) after exchanging heat, is entered into the first header 1, then passes through the first openings 7A to enter into the first distribution-collection tube 5, and is finally discharged out of the heat exchanger via the first distribution-collection tube 5. Therefore, the flow of the liquid refrigerant may not be affected and disturbed by the portion of each tube 3 extended into the first header 1, thus avoiding generating vortexes, reducing the flow resistance of the refrigerant, balancing the flow resistance of the refrigerant in the plurality of tubes 3 at the distal and proximal ends of the outlet header, improving the distribution uniformity of the refrigerant in the plurality of tubes 3 at the distal end and proximal ends of the outlet header, and thereby improving the heat-transfer performance and effect.

Therefore, according to embodiments of the invention, the first and second distribution-collection tubes 5, 6 are extended into the first and second headers, respectively. In this way, the distribution uniformity of the refrigerant in each tube 3 may be improved, the separation of vapor refrigerant and liquid refrigerant in the two-phase flow may be reduced, the generation of vortexes may be avoided, the flow resistance of the refrigerant in the plurality of tubes 3 at the distal and proximal ends of the outlet header may be balanced, and the distribution uniformity of the refrigerant in the plurality of tubes 3 at the distal and proximal ends of the outlet header may be improved, thereby improving the heat-transfer performance and effect.

Furthermore, with the heat exchanger according to embodiments of the invention, by detaching the first fixing nut 11*a* and second fixing nut 11*b*, the first distribution-collection tube 5 and first sleeve 10*a* as well as the second distribution-collection tube 6 and second sleeve 10*b* may be detached so that the replacement and maintenance of the first distribution-collection tube 5 and second distribution-collection tube 6 are convenient. And, the distribution and collection of the refrigerant are easy to control, thus satisfying requirements of different types of heat exchangers used in different applications. Meanwhile, impurities in the first and second headers 1, 2 may be effectively removed regularly, and the service life of the heat exchanger may be lengthened.

Moreover, by replacing the first and second adjustment washers 12*a* and 12*b*, the lengths of the first and second distribution-collection tubes 5, 6 extended into the first and second headers 1, 2 may be adjusted, respectively. In this way, it is possible to adjust the distribution and collection of the refrigerant in the first and second headers 1, 2, thus improving the applicability and heat-transfer performance.

In some embodiments of the invention, as shown in FIGS. 2*a*-2*e*, the first and second distribution-collection tubes 5, 6 with different forms of first and second openings 7A, 7B are shown. It should be noted that, in the embodiments shown in FIGS. 2*a*-2*e*, the first and second distribution-collection tubes 5, 6 are straight tubes. However, the invention is not limited to this. For example, the open ends (i.e., the left ends) of the first and second distribution-collection tubes 5, 6 may be bent to L-shape. When extended into the first and second headers 1, 2, respectively, the bent portions of the first and second distribution-collection tubes 5, 6 can serve the functions of the connection pipes.

Figure 2A:
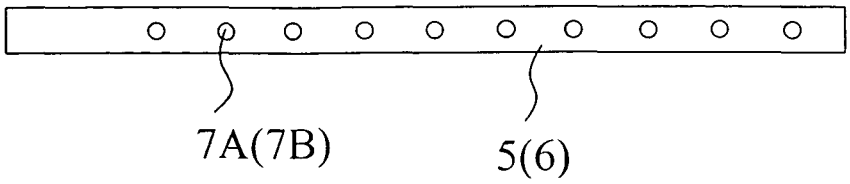
Figure 2B:
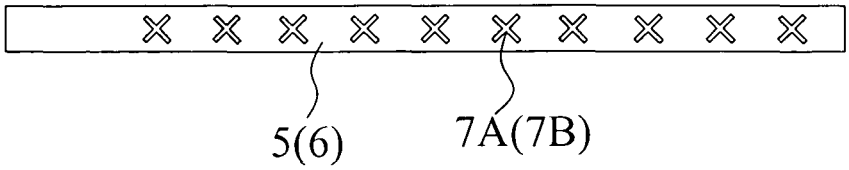

As shown in FIG. 2*a*, the first and second openings 7A, 7B are circular. As shown in FIGS. 2*b*-2*e*, the first and second openings 7A, 7B may be non-circular, thus improving the distribution effect of the refrigerant. For example, the non-circular first and second openings 7A, 7B are in the form of slot. In this embodiment, when the refrigerant is distributed from the first distribution-collection tube 5 into the first header 1 or from the second distribution-collection tube 6 into the second header 2, the distribution effect may be further improved. The slots may be, for example, X-shaped slots, as shown in FIG. 2*b*.

Figure 2C:
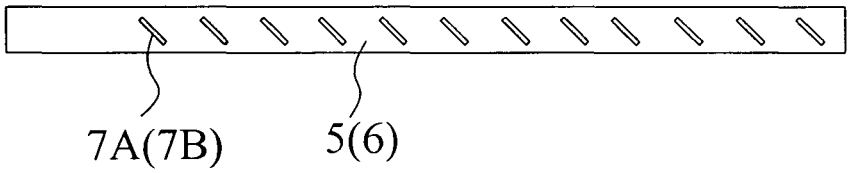
Figure 2D:
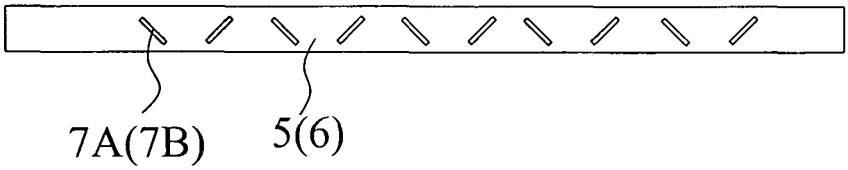
Figure 2E:
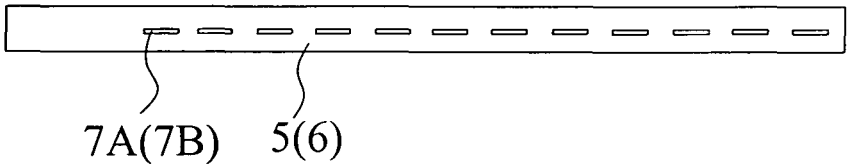

In alternative embodiments of the invention, the slots may be rectangular slots, and the longitudinal direction of the rectangular slots may be parallel to (as shown in FIG. 2*e*), orthogonal to, or inclined relative to (as shown in FIG. 2*c*) the longitudinal direction of the first and second distribution-collection tubes 5, 6. The inclined direction of the rectangular slots may be identical with each other (as shown in FIG. 2*c*). Alternatively, the inclined direction of two adjacent rectangular slots may be opposite to each other (as shown in FIG. 2*d*).

It should be noted that, according to embodiments of the invention, the shape of the first and second openings 7A, 7B and arrangement patterns of the first and second openings 7A, 7B in the first and second distribution-collection tubes 5, 6, respectively, are not limited to the above embodiments. The first and second openings 7A, 7B may be helically arranged in the first and second distribution-collection tubes 5, 6 along the longitudinal direction, respectively.

Figure 3A:
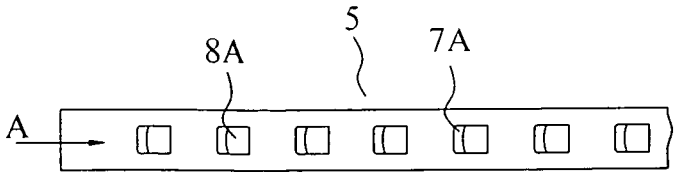
Figure 3B:
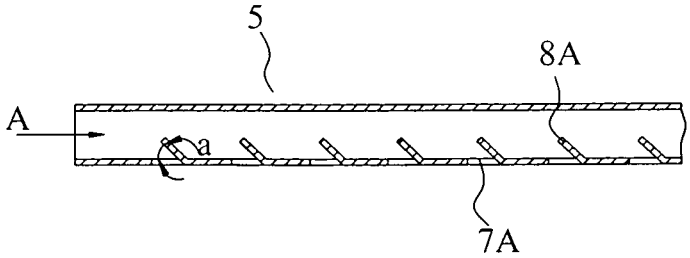
Figure 3C:
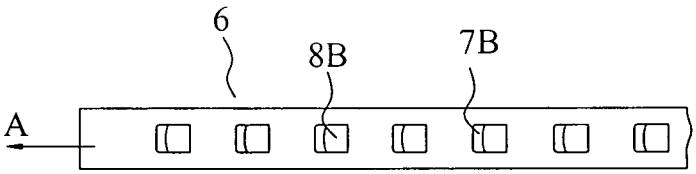
Figure 3D:
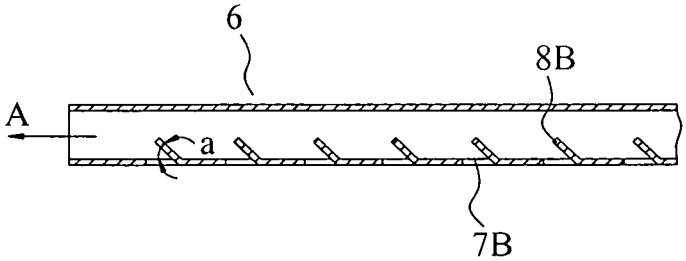

FIGS. 3*a* and 3*b* are the plan view and cross-sectional view of the first distribution-collection tube 5, respectively, when the heat exchanger is used as an evaporator, in which the refrigerant flows into the first distribution-collection tube 5 along arrow "A." FIGS. 3*c* and 3*d* are the plan view and sectional view of the second distribution-collection tube 6, respectively, when the heat exchanger is used as an evaporator, in which the refrigerant flows out the second distribution-collection tube 6 along arrow "A."

As shown in FIGS. 3*a* and 3*b*, areas of the first openings 7A are decreased gradually along a direction from the distal end toward the proximal end of the first distribution-collection tube 5. As shown in FIGS. 3*c* and 3*d*, areas of the second openings 7B are decreased gradually along a direction from the distal end toward the proximal end of the second distribution-collection tube 6.

Figure 3E:
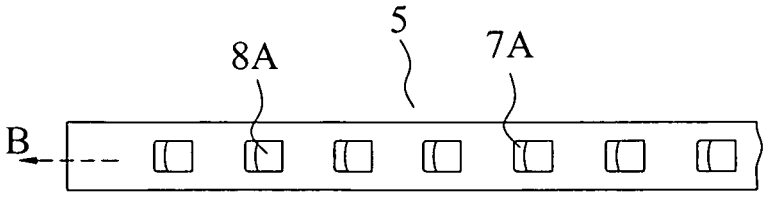
Figure 3F:
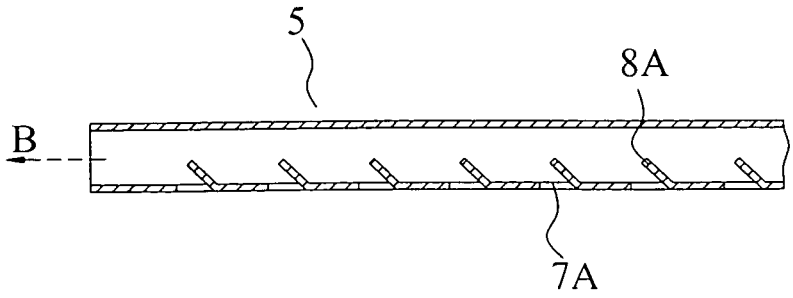
Figure 3G:
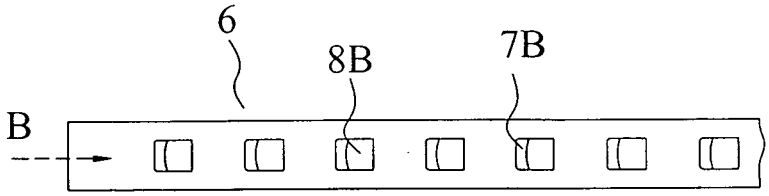
Figure 3H:
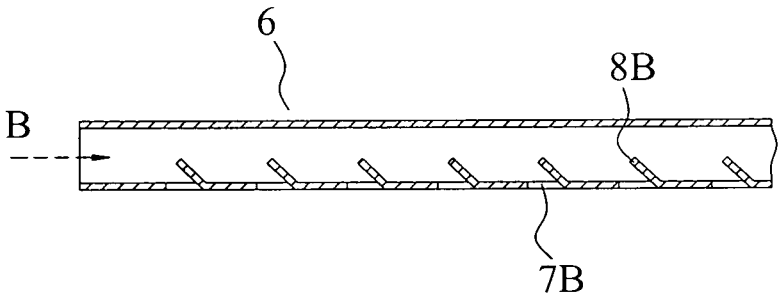

FIGS. 3*e* and 3*f* are the plan view and sectional view of the first distribution-collection tube 5, respectively, when the heat exchanger is used as a condenser, in which the refrigerant flows out the first distribution-collection tube 5 along arrow "B." FIGS. 3*g* and 3*h* are the plan view and cross-sectional view of the second distribution-collection tube 6, respectively, when the heat exchanger is used as a condenser, in which the refrigerant flows into the second distribution-collection tube 6 along arrow "B."

As shown in FIGS. 3*e* and 3*f*, areas of the first openings 7A are decreased gradually along a direction from the distal end toward the proximal end of the first distribution-collection tube 5. As shown in FIGS. 3*g* and 3*h*, areas of the second openings 7B are decreased gradually along a direction from the distal end toward the proximal end of the second distribution-collection tube 6.

Figure 3I:
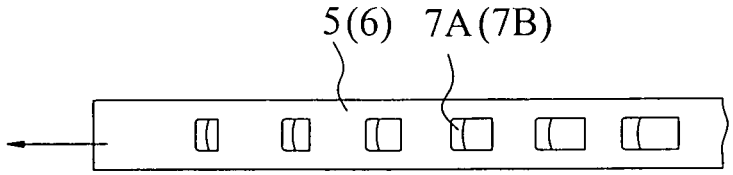
Figure 3J:
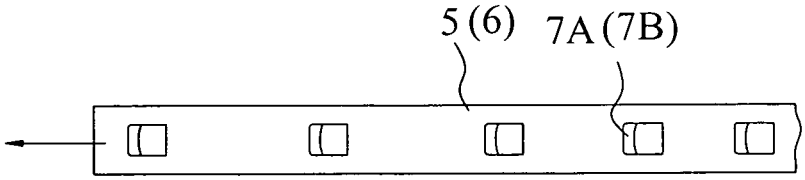
Figure 4:
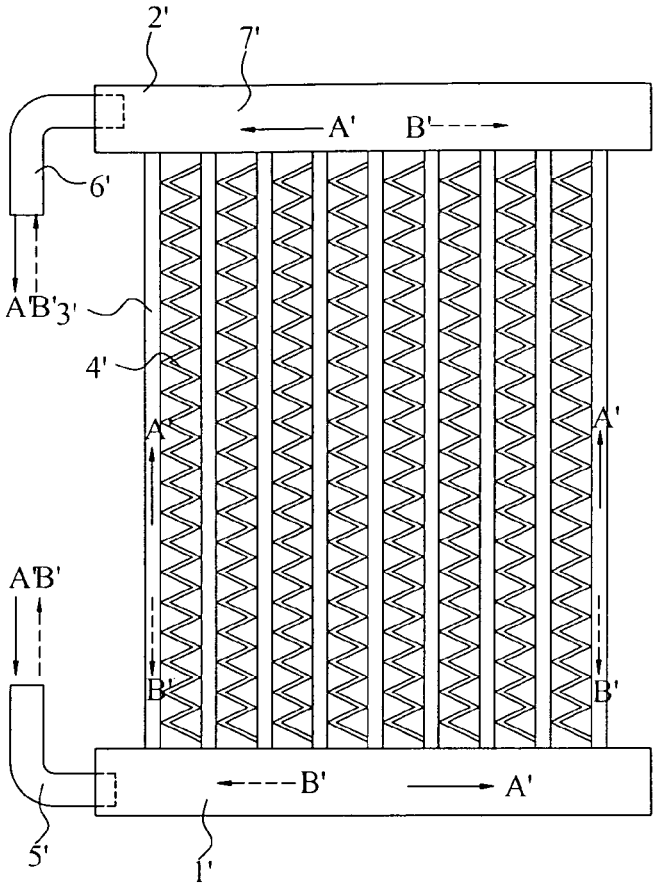
FIG. 4 is a schematic view of the conventional heat exchanger.
Figure 5:
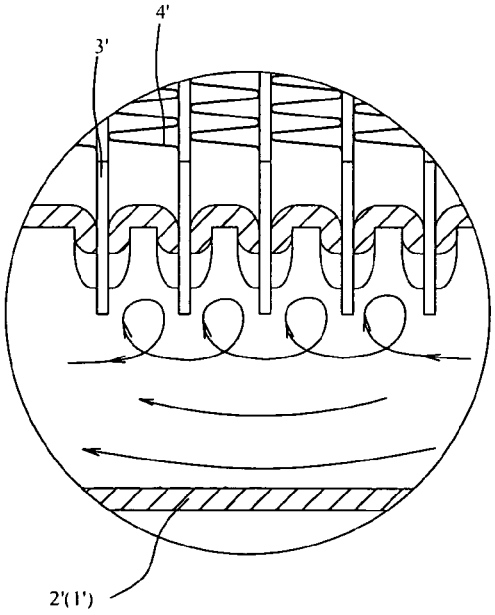
FIG. 5 is a partially enlarged view of the first or second distribution-collection tube that is used as outlet header of the conventional heat exchanger.

FIG. 3*i* is an embodiment of the first distribution-collection tube 5 or second distribution-collection tube 6 that is used as an outlet header of the heat exchanger, and FIG. 3*j* is another embodiment of the first distribution-collection tube 5 or second distribution-collection tube 6 that is used. As shown in FIGS. 3*i* and 3*j*, densities of the first openings 7A are decreased gradually along a direction from the distal end toward the proximal end of the first distribution-collection tube 5, and densities of the second openings 7B are decreased gradually along a direction from the distal end toward the proximal end of the second distribution-collection tube 6.

Advantageously, by decreasing the areas and/or densities of the first openings 7A gradually along a direction from the distal end toward the proximal end of the first distribution-collection tube 5 as well as the areas and/or densities of the second openings 7B gradually along a direction from the distal end toward the proximal end of the second distribution-collection tube 6, the same pressure drop of the refrigerant from each first opening 7A to the proximal end of the first distribution-collection tube 5 may be achieved. And, the same pressure drop of the refrigerant from each second opening 7B to the proximal end of the second distribution-collection tube 6 may be achieved, thereby further improving the distribution uniformity of the refrigerant and heat-transfer effect.

In some embodiments of the invention, as shown in FIGS. 3*a*-3*j*, a second flanging 8B is formed at each second opening 7B and turned toward the interior of the second distribution-collection tube 6. The second flanging 8B may be, for example, flat or arc-shaped. An extending direction of the second flanging 8B is at an acute angle "a" with the direction from the distal end toward the proximal end of the second distribution-collection tube 6 (i.e., the right-to-left direction in FIGS. 3*c*-3*d* and FIGS. 3*g*-3*h* or flow direction of the refrigerant in the distribution-collection tube 6 when the second header 2 is used as an outlet header). The second flanging 8B may be formed by punching a portion of the wall of the second distribution-collection tube 6.

As shown in FIGS. 3*a*-3*j*, a first flanging 8A is formed at each second opening 7A and turned toward the interior of the first distribution-collection tube 5. The second flanging 8A may be, for example, flat or arc-shaped. An extending direction of the first flanging 8A is at an acute angle "a" with the direction from the distal end of the first distribution-collection tube 5 to the proximal end of the first distribution-collection tube 5. The first flanging 8A may be formed by punching a portion of the wall of the first distribution-collection tube 5.

As shown in FIGS. 3*a*-3*d*, the flow of the refrigerant in the first and second distribution-collection tubes 5, 6 is shown when the first header 1 is used as an inlet header and the second header 2 is used as an outlet header. As shown in FIGS. 3*e*-3*h*, the flow of the refrigerant in the first and second distribution-collection tubes 5, 6 is shown when the second header 2 is used as an inlet header and the first header 1 is used as an outlet header.

As shown in FIG. 3*d*, when the second header 2 is used as an outlet header, the extending direction of the second flanging 8B is at an acute angle with flow direction "A" of the refrigerant in the second distribution-collection tube 6. In this way, the second flanging 8B are advantageous for guiding the refrigerant into the second distribution-collection tube 6 from the second header 2 via the second openings 7B, thus reducing the pressure drop in the second distribution-collection tube 6, effectively improving the distribution uniformity of the refrigerant, and thereby improving the refrigeration performance of the heat exchanger.

Similarly, as shown in FIG. 3*f*, when the first header 1 is used as an outlet header, the extending direction of the first flanging 8A is at an acute angle with flow direction "B" of the refrigerant in the first distribution-collection tube 5. In this way, the first flanging 8A are advantageous for guiding the refrigerant into the first distribution-collection tube 5 from the first header 1 via the first openings 7A, thus reducing the pressure drop in the first distribution-collection tube 5, effectively improving the distribution uniformity of the refrigerant, and thereby improving the refrigeration performance of the heat exchanger.

Hereinafter, the operation principle of the heat exchanger according to embodiments of the invention will be described in detail with reference to FIG. 1. When the heat exchanger is used as an evaporator, the first header 1 is used as an inlet header of vapor and liquid refrigerant, and the second header 2 is used as an outlet header. The first distribution-collection tube 5 is used for distributing the refrigerant, and the second distribution-collection tube 6 is used for collecting the refrigerant.

The liquid refrigerant is entered into the first distribution-collection tube 5 along arrow "A" in FIG. 1, distributed into the first header 1 via the first openings 7A, and then becomes vapor refrigerant after exchanging heat with the outside environment. After the vapor refrigerant is entered into the second header 2, the refrigerant passes through the second openings 7B of the second distribution-collection tube 6 to enter into the second distribution-collection tube 6. That is, the refrigerant does not flow within the second header 2 from the distal end to the proximal end and is finally discharged out of the heat exchanger via the second distribution-collection tube 6. In this case, the flow of the vapor refrigerant in the second distribution-collection tube 6 is not disturbed by the portions of the plurality of tubes 3 extended into the second header 2, thus avoiding generating vortexes and distributing the refrigerant uniformly.

When the heat exchanger is used as a condenser, the first header 1 is used as an outlet header of the liquid refrigerant, and the second header 2 is used as an inlet header of the vapor refrigerant. The first distribution-collection tube 5 is used for collecting the refrigerant, and the second distribution-collection tube 6 is used for distributing the refrigerant.

The refrigerant is entered into the second header 2 from the second connection pipe 6' along dashed-line arrow "B," is distributed into the second header 2 via the second openings 7B, becomes liquid refrigerant after exchanging heat with the outside environment during passing through the plurality of tubes 3, is entered into the first header 1, collected into the first distribution-collection tube 5 via the first openings 7A, and is finally discharged out of the heat exchanger via the first connection pipe 5. In this case, the flow of the refrigerant in the first distribution-collection tube 5 may not be disturbed by portions of the plurality of tubes 3 extended into the first header 1, thus avoiding generating vortexes and distributing the refrigerant uniformly.

Furthermore, according to different types and applications of the heat exchanger, the first distribution-collection tube 5 and/or second distribution-collection tube 6 may be replaced, and the length of the first and second distribution-collection tubes 5, 6 extended into the first and second headers 1, 2 may be adjusted, respectively, thus adjusting the distribution of the refrigerant. Furthermore, when the heat exchanger is used for a period of time, the first and second distribution-collection tubes 5, 6 may be detached to remove impurities in the second distribution-collection tubes 5, 6.

According to embodiments of the invention, the first and second distribution-collection tubes 5, 6 are detachable, and lengths of the first and second distribution-collection tubes 5, 6 extended into the first and second headers 1, 2 are adjustable so that the refrigerant can be distributed uniformly. And, the flow of the refrigerant is not disturbed and affected disadvantageously by the portions of the plurality of tubes 3 extended into the first and second headers 1, 2.

With use of the invention, heat-transfer performance of a heat exchanger is improved. More specifically, uniform distribution of the refrigerant is improved. Also, flow of the refrigerant is not disturbed. And, heat-transfer efficiency is improved. Furthermore, replacement and maintenance are facilitated. In addition, requirements of different types of heat exchangers used in different applications are satisfied. Moreover, effective removal is regular. Plus, service life of a heat exchanger is extended. Distribution of the refrigerant is effectively adjusted as well.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A heat exchanger comprising:

a first header;

a second header spaced apart from said first header by a predetermined distance;

a plurality of tubes two ends of each of which are connected with said first and second headers so as to communicate said first and second headers, respectively;

a plurality of fins each of which is disposed between adjacent said tubes;

a first end cover formed with a first center hole and fixed to a proximal end of said first header;

a first sleeve a distal end of which passes through said first center hole so as to extend into said first header and a proximal end thereof is held by a proximal end surface of said first end cover;

a first distribution-collection tube fixed to said first sleeve and defining an open proximal end and a closed distal end passing through said first sleeve to extend into said first header in which a plurality of first openings are formed along a longitudinal direction of said first distribution-collection tube in a portion of said first distribution-collection tube extended into said first header; and a first fixing nut screwed onto said first end cover so as to press said proximal end of said first sleeve against said proximal end surface of said first end cover.

2. A heat exchanger as set forth in claim 1 further comprising:

a second end cover formed with a second center hole and fixed to a proximal end of said second header;

a second sleeve a distal end of which passes through said second center hole to extend into said second header and a proximal end thereof is held by a proximal end surface of said second end cover;

a second distribution-collection tube fixed to said second sleeve and defining an open proximal end and a closed distal end passing through said second sleeve to extend into said second header in which a plurality of second openings are formed along a longitudinal direction of said second distribution-collection tube in a portion of said second distribution-collection tube extended into said second header; and a second fixing nut screwed onto said second end cover so as to press said proximal end of said second sleeve against said proximal end surface of said second end cover.

3. A heat exchanger as set forth in claim 2, wherein said proximal end of said first sleeve is formed with a first flange having an outer diameter larger than a diameter of said first center hole and said proximal end of said second sleeve is formed with a second flange having an outer diameter larger than a diameter of said second center hole.

4. A heat exchanger as set forth in claim 3, wherein a first adjustment washer is disposed between said first flange and said proximal end of said first end cover and a second adjustment washer is disposed between said second flange and said proximal end of said second end cover.

5. A heat exchanger as set forth in claim 2, wherein a first seal ring is disposed between said first sleeve and first end cover and a second seal ring is disposed between said second sleeve and second end cover.

6. A heat exchanger as set forth in claim 2, wherein said distal ends of said first and second distribution-collection tubes are extended inside said first and second headers adjacent to said distal ends of said first and second headers, respectively.

7. A heat exchanger as set forth in claim 2, wherein said first and second openings are non-circular.

8. A heat exchanger as set forth in claim 7, wherein said first and second openings are in the form of slot.

9. A heat exchanger as set forth in claim 8, wherein said first and second openings are either of rectangular and X-shaped slots.

10. A heat exchanger as set forth in claim 2, wherein areas of said first openings are decreased gradually along a direction from said distal end of said first distribution-collection tube to said proximal end of said first distribution-collection tube and areas of said second openings are decreased gradually along a direction from said distal end of said second distribution-collection tube to said proximal end of said second distribution-collection tube.

11. A heat exchanger as set forth in claim 2, wherein densities of said first openings are decreased gradually along a direction from said distal end of said first distribution-collection tube to said proximal end of said first distribution-collection tube and densities of said second openings are decreased gradually along a direction from said distal end of said second distribution-collection tube to said proximal end of said second distribution-collection tube.

12. A heat exchanger as set forth in claim 2, wherein a first flanging is formed at each of said first openings and turned toward an interior of said first distribution-collection tube and a second flanging is formed at each of said second openings and turned toward an interior of said second distribution-collection tube.

13. A heat exchanger as set forth in claim 12, wherein an extending direction of said first flanging is at an acute angle with the direction from said distal end of said first distribution-collection tube to said proximal end of said first distribution-collection tube and an extending direction of said second flanging is at an acute angle with the direction from said distal end of said second distribution-collection tube to said proximal end of said second distribution-collection tube.

14. A heat exchanger as set forth in claim 12, wherein said first and second flangings are either of flat and arc-shaped.

* * * * *